US011384935B2

(12) United States Patent
Karaki

(10) Patent No.: US 11,384,935 B2
(45) Date of Patent: Jul. 12, 2022

(54) COMBUSTION APPARATUS AND HOT WATER APPARATUS

(71) Applicant: NORITZ CORPORATION, Hyogo (JP)

(72) Inventor: Tatsuya Karaki, Akashi (JP)

(73) Assignee: NORITZ CORPORATION, Hyogo (JP)

( * ) Notice: Subject to any disclaimer, the term of this patent is extended or adjusted under 35 U.S.C. 154(b) by 353 days.

(21) Appl. No.: 16/573,640

(22) Filed: Sep. 17, 2019

(65) Prior Publication Data

US 2020/0096197 A1 Mar. 26, 2020

(30) Foreign Application Priority Data

Sep. 25, 2018 (JP) ..... JP2018-178403

(51) Int. Cl.
*F23N 5/24* (2006.01)
*F24H 1/14* (2022.01)
*F24H 9/20* (2022.01)

(52) U.S. Cl.
CPC ..... *F23N 5/242* (2013.01); *F24H 1/14* (2013.01); *F24H 9/2035* (2013.01); *F23N 2229/16* (2020.01); *F23N 2237/10* (2020.01); *F23N 2241/04* (2020.01)

(58) Field of Classification Search
CPC ..... F23N 5/242
See application file for complete search history.

(56) References Cited

U.S. PATENT DOCUMENTS 2,112,736 A * 3/1938 Cockrell ..... F23N 5/123 361/170
5,919,035 A * 7/1999 Iwama ..... F23N 5/02 431/22
7,051,683 B1 * 5/2006 Lee ..... F23N 5/123 122/14.21
2011/0271880 A1 * 11/2011 Thompson ..... F23N 5/184 110/186

(Continued)

FOREIGN PATENT DOCUMENTS

JP S56-149251 U 11/1981
JP 62178815 A * 8/1987 ..... F23N 5/123

(Continued)

OTHER PUBLICATIONS

JP62178815A—machine translation (Year: 1987).*
JP2010127467A_machine translation (Year: 2010).*

*Primary Examiner* — Nathaniel Herzfeld
(74) *Attorney, Agent, or Firm* — Studebaker & Brackett PC

(57) ABSTRACT

A combustion apparatus includes a burner configured to produce flames, a first flame rod and a second flame rod, and a controller. The burner is configured to be controlled, by the controller, to be in a first output state, and a second output state in which output is smaller than in the first output state. The first flame rod makes contact with the flames produced at the burner in a normal combustion state. The second flame rod makes contact with the flames produced at the burner in the normal combustion state when the burner is being controlled to be in the first output state, and does not make contact with the flames produced at the burner in the normal combustion state when the burner is being controlled to be in the second output state.

5 Claims, 5 Drawing Sheets

(56) References Cited

U.S. PATENT DOCUMENTS

| | | | | |
|---|---|---|---|---|
| 2012/0138149 | A1* | 6/2012 | Hatada | G05B 15/02 137/1 |
| 2017/0350617 | A1* | 12/2017 | Ojiro | F24H 1/403 |

FOREIGN PATENT DOCUMENTS

| | | | | |
|---|---|---|---|---|
| JP | 06323532 | A | * | 11/1994 |
| JP | 2010127467 | A | * | 6/2010 |

* cited by examiner

COMBUSTION APPARATUS AND HOT WATER APPARATUS

BACKGROUND OF THE INVENTION

Field of the Invention

The present invention relates to a combustion apparatus and a hot water apparatus.

Description of the Background Art

Japanese Utility Model Laying-Open No. 56-149251 describes a safety device for a gas burner, which includes a burner, a first detection element, a second detection element, and a controller. The burner produces flames upward. The first detection element is arranged above the burner. The second detection element is arranged above the first detection element.

During normal combustion of the burner, the first detection element is in contact with the flames produced at the burner, whereas the second detection element is not in contact with the flames produced at the burner. During abnormal combustion (incomplete combustion) of the burner, the flames produced at the burner are extended. As a result, the flames produced at the burner and the second detection element come into contact with each other. By detecting the contact between the flames produced at the burner and the second detection element, the controller detects abnormal combustion of the burner.

The higher the degree of abnormal combustion (the lower the oxygen concentration), the further the extension of flames produced from the burner.

SUMMARY OF THE INVENTION

Even during normal combustion of a burner, flames produced at the burner are extended by increasing output of the burner. In the construction of the safety device for a gas burner described in Japanese Utility Model Laying-Open No. 56-149251, it is impossible to distinguish between the extension of flames due to increase in output of the burner and the extension of flames due to abnormal combustion of the burner, and it is thus difficult to address a problem when the burner has variable output.

The present invention was made in view of the problem with conventional techniques as described above. More specifically, the present invention aims to provide a combustion apparatus capable of detecting abnormal combustion of a burner when the burner has variable output.

A combustion apparatus according to one aspect of the present invention includes a burner configured to produce flames, a first flame rod and a second flame rod, and a controller. The burner is configured to be controlled, by the controller, to be in a first output state, and a second output state in which output is smaller than in the first output state.

The first flame rod is arranged at a position where it makes contact with the flames produced at the burner in a normal combustion state when the burner is being controlled to be in the first output state and the second output state. The second flame rod is arranged at a position where it makes contact with the flames produced at the burner in the normal combustion state when the burner is being controlled to be in the first output state, and does not make contact with the flames produced at the burner in the normal combustion state when the burner is being controlled to be in the second output state. The controller is configured to determine that the burner is in an abnormal combustion state when, with the burner being controlled to be in the second output state, it is detected that the second flame rod and the flames produced at the burner are in contact with each other.

In the combustion apparatus, the controller may be configured to determine that the burner is in the normal combustion state when, with the burner being controlled to be in the first output state, it is detected that the first flame rod and the flames produced at the burner are in contact with each other and the second flame rod and the flames produced at the burner are in contact with each other.

In the combustion apparatus, the controller may be configured to determine that the burner is in the abnormal combustion state when it is detected that the first flame rod and the flames produced at the burner are not in contact with each other.

The combustion apparatus may further include a heat exchanger having a first sidewall. In plan view, a portion of the first flame rod that is farthest from the first sidewall may be located farther from the first sidewall than a portion of the second flame rod that is farthest from the first sidewall.

In the combustion apparatus, the heat exchanger may further have a second sidewall facing the first sidewall. The burner may have a plurality of burner ports through which the flames are produced. In cross-sectional view parallel to a direction from the first sidewall toward the second sidewall, the portion of the first flame rod that is farthest from the first sidewall may be located closer to the second sidewall than a virtual line obtained by extending a central axis of one of the burner ports that is closest to the first sidewall. In cross-sectional view parallel to the direction from the first sidewall toward the second sidewall, the portion of the second flame rod that is farthest from the first sidewall may be located closer to the first sidewall than the virtual line.

The combustion apparatus may further include a heat exchanger having a first sidewall and a second sidewall facing the first sidewall, and an insulator portion having the second flame rod inserted therein. The heat exchanger may further have a shell pipe attached to a surface of the first sidewall on a side of the second sidewall. The insulator portion may be inserted in the first sidewall below the shell pipe. A portion of the second flame rod overlapping the shell pipe in plan view may be covered with the insulator portion.

A hot water apparatus according to one aspect of the present invention includes a combustion apparatus. This combustion apparatus is the combustion apparatus described above.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
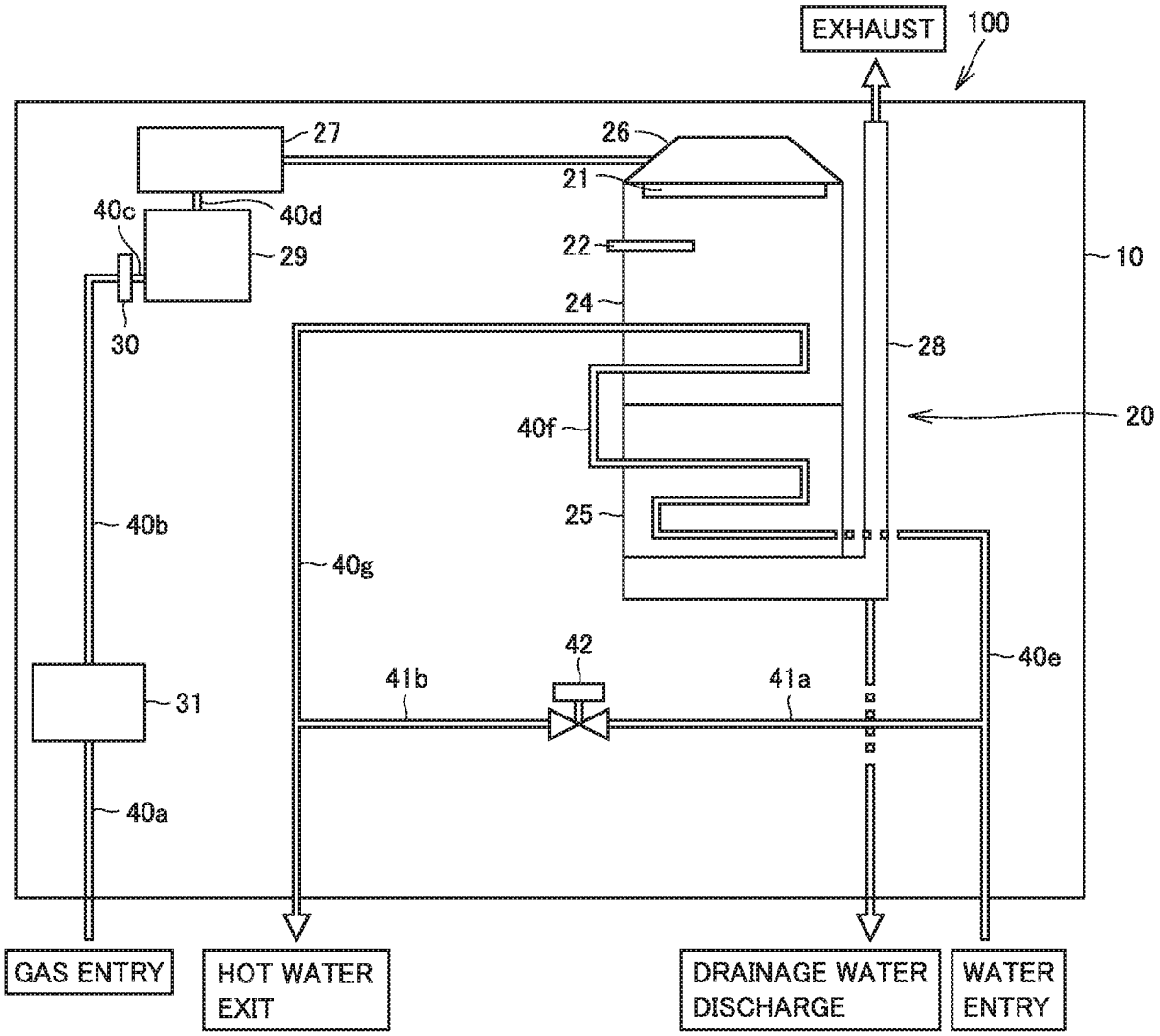
FIG. 1 is a schematic diagram of a hot water apparatus 100 according to an embodiment.

An embodiment of the present invention will be described with reference to the drawings. The same or corresponding parts are denoted by the same reference characters in the following drawings, and redundant description is not repeated.

(General Construction of Hot Water Apparatus According to Embodiment)

In the following, a general construction of a hot water apparatus 100 according to the embodiment is described.

As shown in FIG. 1, hot water apparatus 100 includes a housing 10, a combustion apparatus 20, pipes 40*a* to 40*g*, a bypass pipe 41*a* and a bypass pipe 41*b*, and a bypass servo 42.

Combustion apparatus 20 includes a burner 21, an ignition plug 22, a first flame rod 23*a* (not shown in FIG. 1) and a second flame rod 23*b* (not shown in FIG. 1), and a primary heat exchanger 24. Combustion apparatus 20 further includes a secondary heat exchanger 25, a chamber 26, a fan 27, a duct 28, a venturi 29, an orifice 30, and a gas valve 31.

Burner 21, ignition plug 22, first flame rod 23*a* and second flame rod 23*b*, primary heat exchanger 24 and secondary heat exchanger 25, chamber 26, fan 27, duct 28, venturi 29, orifice 30, gas valve 31, pipe 40*a* to pipe 40*g*, bypass pipe 41*a*, bypass pipe 41*b* and bypass servo 42 are arranged in housing 10.

Burner 21 is arranged below chamber 26. Primary heat exchanger 24 is arranged below burner 21. Ignition plug 22 is arranged below burner 21. Ignition plug 22 is attached to primary heat exchanger 24, for example. Secondary heat exchanger 25 is arranged below primary heat exchanger 24.

Pipe 40*a* has one end from which fuel gas is supplied. Pipe 40*a* has the other end connected to gas valve 31. Pipe 40*b* has one end connected to gas valve 31. Pipe 40*b* has the other end connected to orifice 30. Pipe 40*c* has one end connected to orifice 30. Pipe 40*c* has the other end connected to venturi 29.

Pipe 40*d* has one end connected to venturi 29. Pipe 40*d* has the other end connected to fan 27. Fan 27 is connected to chamber 26.

Pipe 40*e* has one end from which water is supplied. Pipe 40*e* has the other end connected to secondary heat exchanger 25. Pipe 40*f* has one end connected to secondary heat exchanger 25. Pipe 40*f* has the other end connected to primary heat exchanger 24. Pipe 40*g* has one end connected to primary heat exchanger 24. Pipe 40*g* has the other end from which hot water exits.

Bypass pipe 41*a* has one end connected to pipe 40*e*. Bypass pipe 41*a* has the other end connected to bypass servo 42. Bypass pipe 41*b* has one end connected to bypass servo 42. Bypass pipe 41*b* has the other end connected to pipe 40*g*.

Gas valve 31 switches supply and stop of the fuel gas from pipe 40*a*. The pressure of the fuel gas supplied to venturi 29 is thus regulated.

Venturi 29 is configured to take in air from the outside of housing 10. Venturi 29 mixes the air taken in from the outside of housing 10 with the fuel gas supplied to venturi 29 through pipe 40*a*, pipe 40*b*, pipe 40*c*, orifice 30 and gas valve 31 (the fuel gas mixed with the air is hereinafter referred to as mixed gas).

Exhaust from combustion apparatus 20 is discharged to the outside of housing 10 through duct 28. Part of this exhaust, however, is taken in again through venturi 29, which results in reduction in oxygen concentration in the mixed gas, causing abnormal combustion (incomplete combustion) which will be described later.

Fan 27 includes a fan case, an impeller arranged in the fan case, and a motor for driving the impeller to rotate. When the motor drives the impeller to rotate, fan 27 suctions the mixed gas produced at venturi 29 through pipe 40*c*. The suctioned mixed gas is supplied to burner 21 through chamber 26.

The mixed gas is ejected downward through burner ports 21*a* provided in a lower surface of burner 21. The ejected mixed gas is burned by being ignited by ignition plug 22, and turned into combustion gas. The combustion gas is ejected downward (i.e., toward primary heat exchanger 24).

The water supplied to secondary heat exchanger 25 through pipe 40*e* exchanges heat with latent heat of the combustion gas at secondary heat exchanger 25, to thereby have an increased temperature. The water which has passed through secondary heat exchanger 25 is supplied to primary heat exchanger 24 through pipe 40*f*. The water supplied to primary heat exchanger 24 exchanges heat with sensible heat of the combustion gas at primary heat exchanger 24, to thereby have a further increased temperature. The water which has passed through primary heat exchanger 24 flows through pipe 40*g*.

Part of the water flowing through pipe 40*e* flows to bypass pipe 41*a*. A flow rate of water flowing from bypass pipe 41*a* to bypass pipe 41*b* is controlled by bypass servo 42. The water flowing through bypass pipe 41*b* is mixed with the water flowing through pipe 40*g*. That is, the temperature of the water exiting from the other end of pipe 40*g* is adjusted by bypass servo 42 controlling the flow rate of the water flowing from bypass pipe 41*a* to bypass pipe 41*b*.

Water produced by condensation of water vapor in the combustion gas in primary heat exchanger 24 (this water is hereinafter referred to as drainage water) is discharged to the outside of housing 10 through duct 28.

(Detailed Construction of Combustion Apparatus According to Embodiment)

Figure 2:
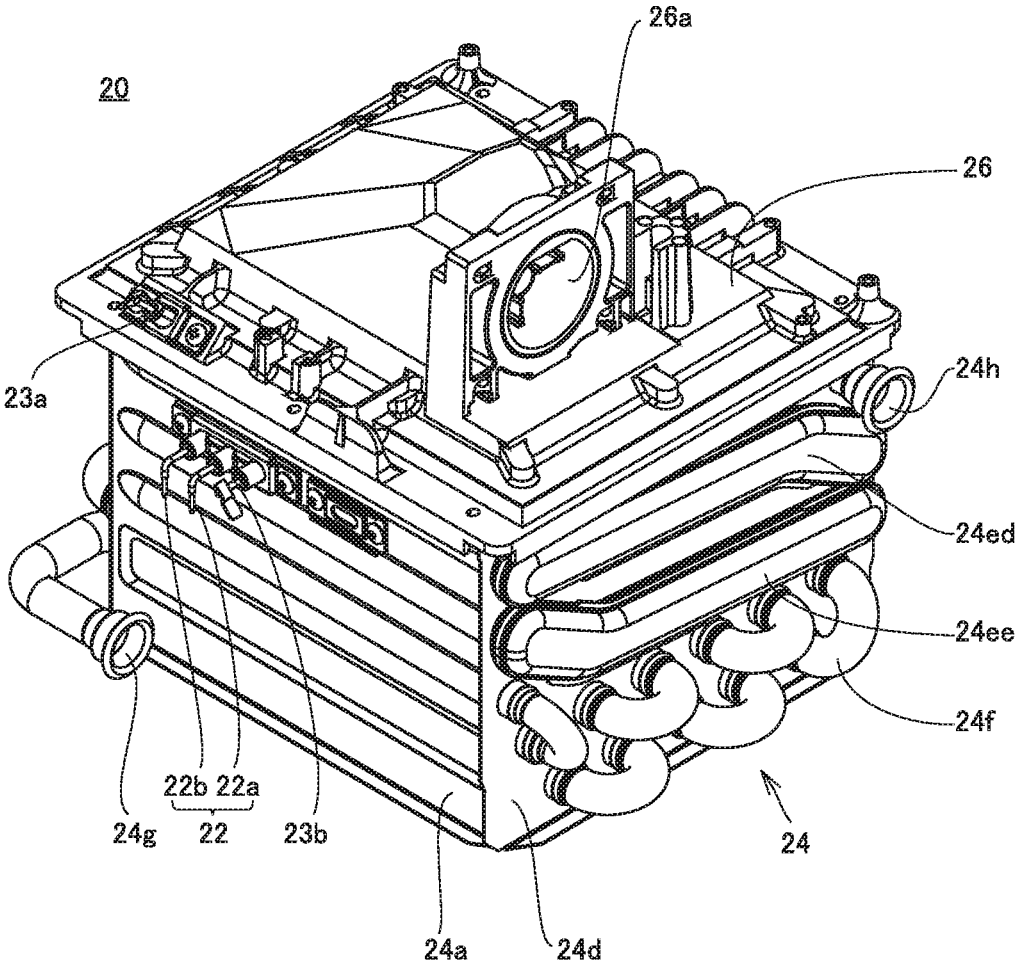
FIG. 2 is a perspective view of a combustion apparatus 20 according to the embodiment.
Figure 3:
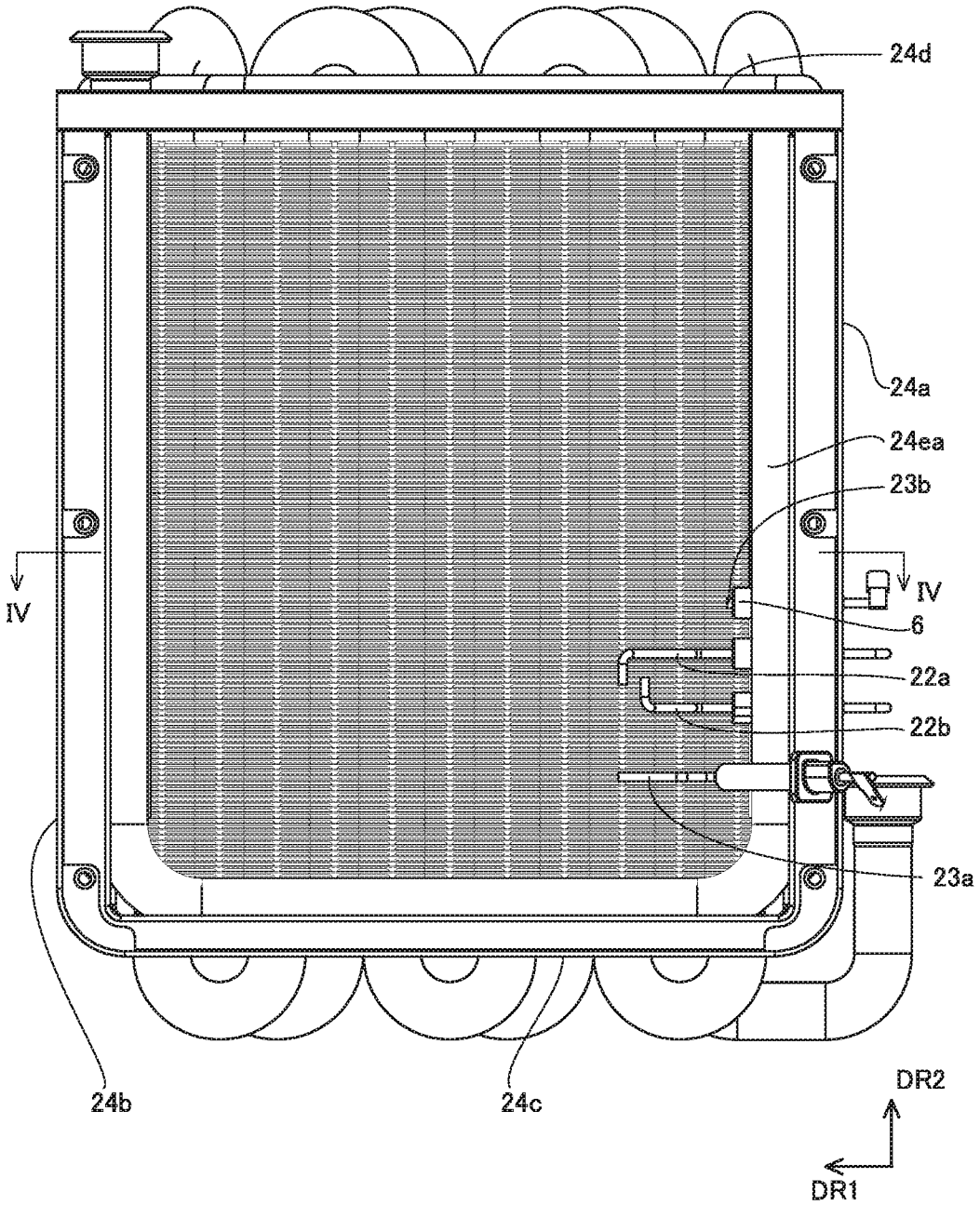
FIG. 3 is a top view of combustion apparatus 20 according to the embodiment.
Figure 4:
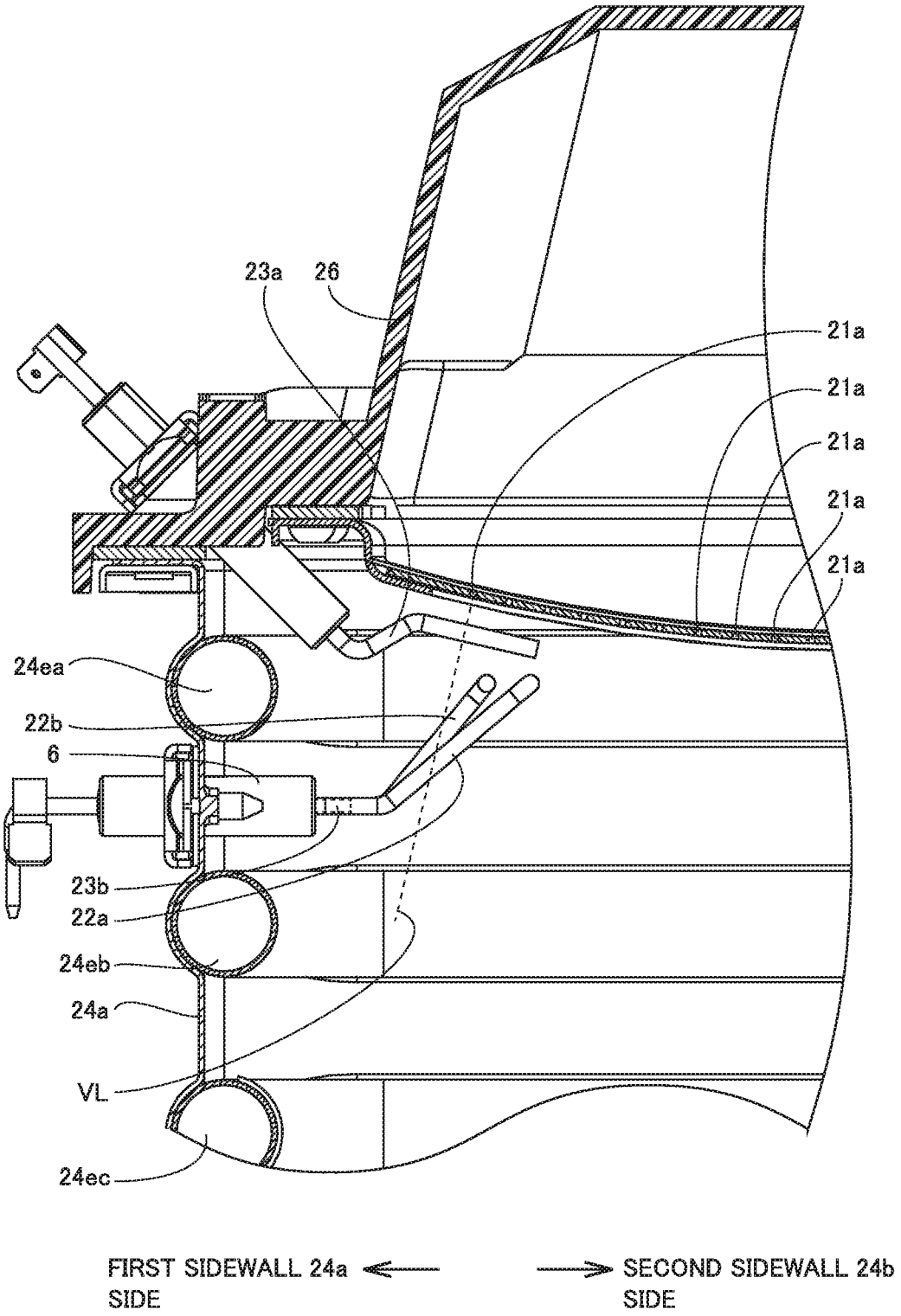
FIG. 4 is a cross-sectional view of combustion apparatus 20 according to the embodiment.

In the following, a detailed construction of combustion apparatus 20 according to the embodiment is described with reference to FIGS. 2, 3 and 4. Secondary heat exchanger 25, fan 27, duct 28, venturi 29, orifice 30 and gas valve 31 are not shown in FIGS. 2 to 4. Chamber 26 is also not shown in FIG. 3 in order to clarify an internal structure of combustion apparatus 20.

Primary heat exchanger 24 has a first sidewall 24*a*, a second sidewall 24*b*, a third sidewall 24*c*, and a fourth sidewall 24*d*. First sidewall 24*a* and second sidewall 24*b* face each other in a first direction DR1. Third sidewall 24*c* and fourth sidewall 24*d* face each other in a second direction DR2 intersecting with first direction DR1. Third sidewall 24*c* is continuous with first sidewall 24*a* and second sidewall 24*b*, and fourth sidewall 24*d* is continuous with first sidewall 24*a* and second sidewall 24*b*.

Primary heat exchanger 24 has a shell pipe 24*ea*, a shell pipe 24*eb* and a shell pipe 24*ec*. Shell pipe 24*ea*, shell pipe 24*eb* and shell pipe 24*ec* are attached along inner wall surfaces of first sidewall 24*a*, second sidewall 24*b* and third sidewall 24*c*.

The inner wall surface of first sidewall 24*a* refers to a surface of first sidewall 24*a* on a side of second sidewall 24*b*, and the inner wall surface of second sidewall 24*b* refers to a surface of second sidewall 24*b* on a side of first sidewall 24*a*. The inner wall surface of third sidewall 24*c* refers to a surface of third sidewall 24*c* on a side of fourth sidewall 24*d*, and the inner wall surface of fourth sidewall 24*d* refers to a surface of fourth sidewall 24*d* on a side of third sidewall 24*c*.

Shell pipe 24*eb* is arranged below shell pipe 24*ea*. Shell pipe 24*ea* and shell pipe 24*eb* are spaced from each other in an up-down direction. Shell pipe 24*ec* is arranged below shell pipe 24*eb*. Shell pipe 24*eb* and shell pipe 24*ec* are spaced from each other in the up-down direction.

Primary heat exchanger 24 further has a shell pipe 24*ed* and a shell pipe 24*ee*. Shell pipe 24*ed* and shell pipe 24*ee* are attached to an outer wall surface of fourth sidewall 24*d*. The outer wall surface of fourth sidewall 24*d* refers to a surface of fourth sidewall 24*d* on a side opposite the side of third sidewall 24*c*. Shell pipe 24*ee* is located below shell pipe 24*ed*. Shell pipe 24*ed* and shell pipe 24*ee* are spaced from each other in the up-down direction.

Shell pipe 24*ed* has one end connected to one end of shell pipe 24*ea*. The other end of shell pipe 24*ea* is an end of shell pipe 24*ea* on a side of a water outlet 24*h*. Shell pipe 24*ed* has the other end connected to one end of shell pipe 24*eb*. Shell pipe 24*ee* has one end connected to the other end of shell pipe 24*eb*. Shell pipe 24*ee* has the other end connected to one end of shell pipe 24*ec*.

Primary heat exchanger 24 further has a pipe 24*f*. Pipe 24*f* is connected at its one end to the other end of shell pipe 24*ec*, and is connected at its other end to a water inlet 24*g*. A number of fins are attached to pipe 24*f*.

Primary heat exchanger 24 further has water inlet 24*g* and water outlet 24*h*. Water inlet 24*g* is connected to the other end of pipe 24*f*. Water outlet 24*h* is connected to one end of pipe 40*g*. Water inlet 24*g* and water outlet 24*h* are connected to each other through shell pipe 24*ea* to shell pipe 24*ee* and pipe 24*f*.

Chamber 26 has an intake port 26*a*. The mixed gas supplied from fan 27 is supplied into chamber 26 through intake port 26*a*. Burner 21 is attached below chamber 26.

The lower surface of burner 21 is provided with the plurality of burner ports 21*a*, as described above. The mixed gas supplied into chamber 26 is ejected through burner ports 21*a*. The lower surface of burner 21 is curved in a downwardly convex manner in cross-sectional view along first direction DR1 (cross-sectional view orthogonal to second direction DR2). A line obtained by extending a central axis of burner port 21*a* that is closest to first sidewall 24*a* will be referred to as a virtual line VL.

Ignition plug 22 is arranged below burner 21, as described above. Ignition plug 22 is composed of a first electrode 22*a* and a second electrode 22*b*. First electrode 22*a* and second electrode 22*b* each have a tip end arranged inside combustion apparatus 20, and each have the other end arranged outside combustion apparatus 20.

The tip ends of first electrode 22*a* and second electrode 22*b* face each other. The tip ends of first electrode 22*a* and second electrode 22*b* are located below the lower surface of burner 21. By passing a current between first electrode 22*a* and second electrode 22*b*, sparks are generated between the tip end of first electrode 22*a* and the tip end of second electrode, leading to ignition of the mixed gas ejected through burner ports 21*a*.

Ignition plug 22 (first electrode 22*a* and second electrode 22*b*) is inserted in first sidewall 24*a*. More specifically, ignition plug 22 is inserted in first sidewall 24*a* between shell pipe 24*ea* and shell pipe 24*eb*.

First flame rod 23*a* is inserted in chamber 26. First flame rod 23*a* has a tip end arranged inside combustion apparatus 20, and has the other end arranged outside combustion apparatus 20. The other end of first flame rod 23*a* is electrically connected to a controller 5 which will be described later.

The tip end of first flame rod 23*a* (portion that is farthest from first sidewall 24*a*) is located below burner 21. Preferably, in cross-sectional view along first direction DR1, the tip end of first flame rod 23*a* (portion that is farthest from first sidewall 24*a*) is located closer to second sidewall 24*b* than virtual line VL. First flame rod 23*a* is arranged at a position where it makes contact with the flames produced at burner 21 in a normal combustion state when burner 21 is being controlled to be in a first output state and a second output state which will be described later.

That burner 21 is in a normal combustion state means that incomplete combustion has not occurred in the fuel gas ejected through burner ports 21*a*. That burner 21 is in an abnormal combustion state, on the other hand, means that incomplete combustion has occurred in the fuel gas ejected through burner ports 21*a*. Here, the incomplete combustion means that carbon monoxide concentration in exhaust gas from the combustion apparatus is equal to or higher than the concentration that has an effect on the human body.

First flame rod 23*a* is made of heat-resistant steel, for example. Since molecules forming the fuel gas are ionized in the flames produced at burner ports 21*a*, the flames exhibit electrical conductivity. Thus, when first flame rod 23*a* is in contact with the flames produced at burner ports 21*a*, a current flows between first flame rod 23*a* and an electrode (not shown) provided on a side of burner 21. By detection of this current, it can be detected that first flame rod 23*a* and the flames produced at burner ports 21*a* are in contact with each other.

Second flame rod 23*b* is inserted in first sidewall 24*a*. More specifically, second flame rod 23*b* is inserted in first sidewall 24*a* between shell pipe 24*ea* and shell pipe 24*eb*. Second flame rod 23*b* has a tip end arranged inside combustion apparatus 20, and has the other end arranged outside combustion apparatus 20. The other end of second flame rod 23*b* is electrically connected to controller 5 which will be described later.

The tip end of second flame rod 23*b* (portion that is farthest from first sidewall 24*a*) is located below the tip end of first flame rod 23*a* (portion that is farthest from first sidewall 24*a*). As will be described later, burner 21 is controlled by controller 5 to be in the first output state, and the second output state in which the output is smaller than in the first output state (the flames produced at burner 21 are shorter than in the first output state). The control of the output state of burner 21 is performed by, for example, varying a flow rate of the mixed gas supplied to burner 21.

Second flame rod 23*b* is arranged at a position where it makes contact with the flames produced at burner 21 in the normal combustion state when burner 21 is being controlled to be in the first output state, and does not make contact with the flames produced at burner 21 in the normal combustion state when burner 21 is being controlled to be in the second output state.

In cross-sectional view along first direction DR1, the tip end of second flame rod 23*b* (portion that is farthest from first sidewall 24*a*) is preferably located closer to first sidewall 24*a* than the tip end of first flame rod 23*a* (portion that is farthest from first sidewall 24*a*). That is, in cross-sectional view along first direction DR1, the tip end of first flame rod 23*a* (portion that is farthest from first sidewall 24*a*) is preferably located farther from first sidewall 24*a* than the tip end of second flame rod 23*b* (portion that is farthest from first sidewall 24*a*). More specifically, in cross-sectional view along first direction DR1, the tip end of second flame rod 23*b* (portion that is farthest from first sidewall 24*a*) is preferably located closer to first sidewall 24*a* than virtual line VL.

Second flame rod 23*b* is made of heat-resistant steel, for example. When second flame rod 23*b* is in contact with the flames produced at burner 21, a current flows between second flame rod 23*b* and the electrode (not shown) provided on a side of burner 21. By detection of this current, it can be detected that second flame rod 23*b* is in contact with the flames produced at burner 21.

Combustion apparatus 20 may further include an insulator portion 6. Insulator portion 6 is made of an insulating material. Insulator portion 6 is attached to first sidewall 24*a*. More specifically, insulator portion 6 is inserted in a through hole provided in first sidewall 24*a* between shell pipe 24*ea* and shell pipe 24*eb*. That is, insulator portion 6 and second flame rod 23*b* are located below shell pipe 24*ea*.

Insulator portion 6 has a first through hole, a second through hole and a third through hole. Second flame rod 23*b* is inserted in the first through hole. First electrode 22*a* and second electrode 22*b* are inserted in the second through hole and the third through hole, respectively.

Second flame rod 23*b* is inserted in insulator portion 6 in such a way that a portion of second flame rod 23*b* overlapping shell pipe 24*ea* in plan view is covered with insulator portion 6. Similarly, ignition plug 22 (first electrode 22*a* and second electrode 22*b*) is inserted in insulator portion 6 in such a way that a portion of ignition plug 22 overlapping shell pipe 24*ea* in plan view is covered with insulator portion 6.

(Operation of Combustion Apparatus According to Embodiment)

In the following, the operation of combustion apparatus 20 according to the embodiment is described with reference to FIG. 5.

Figure 5:
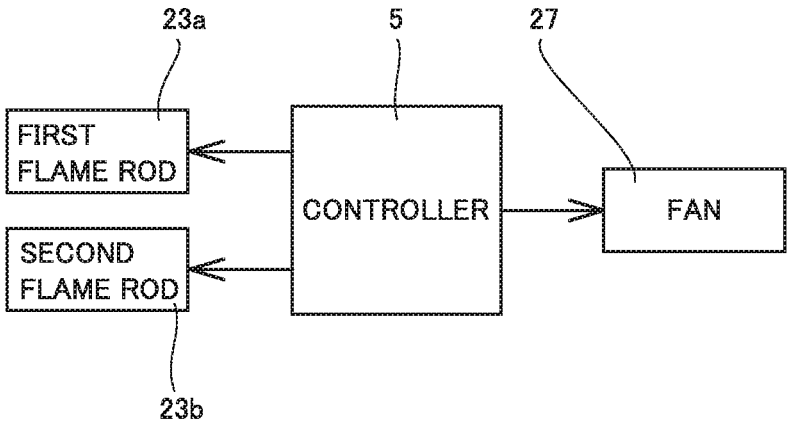
FIG. 5 is a block diagram of combustion apparatus 20 according to the embodiment.

As shown in FIG. 5, fan 27, first flame rod 23*a* and second flame rod 23*b* are connected to controller 5. Controller 5 is composed of a microcontroller, for example.

Burner 21 is controlled to be in the first output state and the second output state by controller 5 controlling fan 27. Burner 21 may be controlled to be in an output state different from the first output state and the second output state by controller 5 controlling fan 27.

When burner 21 is being controlled to be in the second output state by controller 5, and when burner 21 is in the normal combustion state, then first flame rod 23*a* makes contact with the flames produced at burner 21, whereas second flame rod 23*b* does not make contact with the flames produced at burner 21.

However, even when burner 21 is being controlled to be in the second output state by controller 5, the flames produced at burner 21 and second flame rod 23*b* make contact with each other when burner 21 is in the abnormal combustion state. For this reason, controller 5 determines that burner 21 is in the abnormal combustion state when burner 21 is being controlled to be in the second output state, and when it is detected that second flame rod 23*b* is in contact with the flames produced at burner 21 (that is, a current flowing through second flame rod 23*b* is detected).

When burner 21 is being controlled to be in the first output state by controller 5, second flame rod 23*b* makes contact with the flames produced at burner 21 even when burner 21 is in the normal combustion state. For this reason, controller 5 determines that burner 21 is in the normal combustion state when it is detected that first flame rod 23*a* is in contact with the flames produced at burner 21 and the second flame rod is in contact with the flames produced at burner 21 (a current flowing through first flame rod 23*a* and second flame rod 23*b* is detected).

When burner 21 is in the abnormal combustion state, the base of the flames produced at burner 21 may be separated from the lower surface of burner 21, making it impossible to detect the contact between first flame rod 23*a* and the flames produced at burner 21. For this reason, controller 5 determines that burner 21 is in the abnormal combustion state when it is detected that first flame rod 23*a* is not in contact with the flames produced at burner 21 (that no current is flowing through first flame rod 23*a*).

(Effect of Combustion Apparatus According to Embodiment)

In the following, the effect of combustion apparatus 20 according to the embodiment is described.

As described above, in combustion apparatus 20, controller 5 determines whether or not burner 21 is in the abnormal combustion state by considering whether or not second flame rod 23*b* is in contact with the flames produced at burner 21, and the control state of burner 21 (whether it is in the first output state or in the second control state).

In combustion apparatus 20, therefore, it is possible to distinguish between the contact of the flames produced at burner 21 with second flame rod 23*b* due to large output of burner 21, and the contact of the flames produced at burner 21 with second flame rod 23*b* due to abnormal combustion of burner 21. In this manner, according to combustion apparatus 20, the abnormal combustion of burner 21 can be detected even when burner 21 has variable output.

Figure 6:
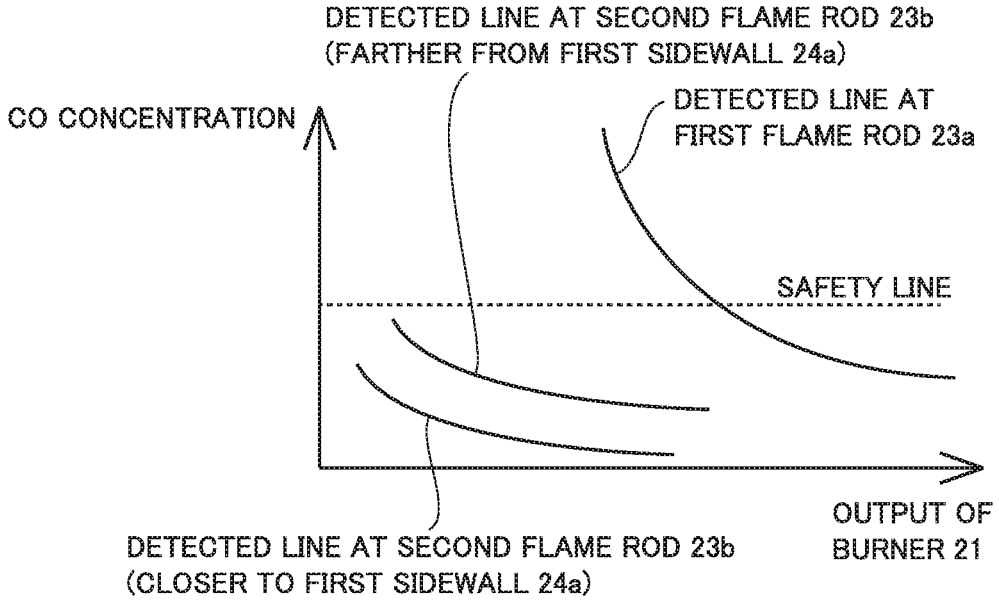
FIG. 6 shows a schematic graph illustrating the effect of combustion apparatus 20 according to the embodiment.

In combustion apparatus 20, by adjusting the distance between the tip end of first flame rod 23*a* and the tip end of second flame rod 23*b* in plan view, the degree of abnormal combustion of burner 21 that can be detected can be changed (see FIG. 6). By positioning the tip end of second flame rod 23*b* closer to first sidewall 24*a* than the tip end of first flame rod 23*a*, therefore, it is possible to detect abnormal combustion of a degree that is difficult to detect using only first flame rod 23*a*.

When second flame rod 23*b* is located below shell pipe 24*ea*, water droplets produced due to condensation on a surface of shell pipe 24*ea* may drop to second flame rod 23*b* from shell pipe 24*ea* located above second flame rod 23*b*. These water droplets cause an electric leakage in second flame rod 23*b*.

When the portion of second flame rod 23*b* overlapping shell pipe 24*ea* in plan view is covered with insulator portion 6, however, the contact between these water droplets and second flame rod 23*b* is suppressed.

Although the embodiment of the present invention has been described as above, the embodiment described above can be modified in various manners. In addition, the scope of the present invention is not limited to the embodiment described above. The scope of the present invention is defined by the terms of the claims, and is intended to include any modifications within the meaning and scope equivalent to the terms of the claims.

INDUSTRIAL APPLICABILITY

The embodiment described above is applied particularly advantageously to a combustion apparatus and a hot water apparatus.

Although the embodiment of the present invention has been described, it should be understood that the embodiment disclosed herein is illustrative and non-restrictive in every respect. The scope of the present invention is defined by the terms of the claims, and is intended to include any modifications within the meaning and scope equivalent to the terms of the claims.

What is claimed is:

1. A combustion apparatus comprising:

a burner configured to produce flames;

a first flame rod and a second flame rod;

a controller; and a heat exchanger having a first sidewall and a second sidewall facing the first sidewall, the burner being configured to be controlled, by the controller, to be in a first output state, and a second output state in which output is smaller than in the first output state, the first flame rod being arranged at a position where it makes contact with the flames produced at the burner in a normal combustion state when the burner is being controlled to be in the first output state and the second output state, the second flame rod being arranged at a position where it makes contact with the flames produced at the burner in the normal combustion state when the burner is being controlled to be in the first output state, and does not make contact with the flames produced at the burner in the normal combustion state when the burner is being controlled to be in the second output state, and the controller being configured to determine that the burner is in an abnormal combustion state when, with the burner being controlled to be in the second output state, it is detected that the second flame rod and the flames produced at the burner are in contact with each other, wherein in plan view, a portion of the first flame rod that is farthest from the first sidewall is located farther from the first sidewall than a portion of the second flame rod that is farthest from the first sidewall, the burner has a plurality of burner ports through which the flames are produced, in cross-sectional view parallel to a direction from the first sidewall toward the second sidewall, the portion of the first flame rod that is farthest from the first sidewall is located closer to the second sidewall than a virtual line obtained by extending a central axis of one of the burner ports that is closest to the first sidewall, and in cross-sectional view parallel to the direction from the first sidewall toward the second sidewall, the portion of the second flame rod that is farthest from the first sidewall is located closer to the first sidewall than the virtual line.

2. The combustion apparatus according to claim 1, wherein the controller is configured to determine that the burner is in the normal combustion state when, with the burner being controlled to be in the first output state, it is detected that the first flame rod and the flames produced at the burner are in contact with each other and the second flame rod and the flames produced at the burner are in contact with each other.

3. The combustion apparatus according to claim 1, wherein the controller is configured to determine that the burner is in the abnormal combustion state when it is detected that the first flame rod and the flames produced at the burner are not in contact with each other.

4. The combustion apparatus according to claim 1, further comprising:

an insulator portion having the second flame rod inserted therein, wherein the heat exchanger further has a shell pipe attached to a surface of the first sidewall on a side of the second sidewall, the insulator portion is inserted in the first sidewall below the shell pipe, and a portion of the second flame rod overlapping the shell pipe in plan view is covered with the insulator portion.

5. A hot water apparatus comprising the combustion apparatus according to claim 1.

* * * * *